US005831186A

United States Patent [19]

Oswood et al.

[11] Patent Number: 5,831,186

[45] Date of Patent: Nov. 3, 1998

[54] ELECTRICAL CONTACT FOR USE IN A CIRCUIT BREAKER AND A METHOD OF MANUFACTURING THEREOF

[75] Inventors: Jon W. Oswood; James P. Bodin; Randy L. Siebels; Eugene W. Wehr, all of Cedar Rapids, Iowa

[73] Assignee: Square D Company, Palatine, Ill.

[21] Appl. No.: 626,706

[22] Filed: Apr. 1, 1996

[51] Int. Cl.[6] ..... B22F 3/12; B22F 5/00

[52] U.S. Cl. ..... 75/243; 75/247; 75/248

[58] Field of Search ..... 75/246, 231, 243, 75/247, 248; 420/501

[56] References Cited

U.S. PATENT DOCUMENTS

| | | | |
|---|---|---|---|
| 2,289,708 | 7/1942 | Jackson | 200/166 |
| 3,864,827 | 2/1975 | Schreiner et al. | 29/630 |
| 4,072,515 | 2/1978 | Motoyoshi et al. | 75/173 A |
| 4,137,076 | 1/1979 | Hoyer et al. | 75/241 |
| 4,153,755 | 5/1979 | Rothkegel et al. | 428/569 |
| 4,294,616 | 10/1981 | Kim et al. | 75/234 |
| 4,325,734 | 4/1982 | Burrage et al. | 75/225 |
| 4,345,130 | 8/1982 | Okutomi et al. | 200/268 |
| 4,457,780 | 7/1984 | Osada et al. | 75/236 |
| 4,622,269 | 11/1986 | Leung et al. | 428/550 |
| 4,689,196 | 8/1987 | Leung | 419/11 |
| 4,699,763 | 10/1987 | Sinharoy et al. | 419/11 |
| 4,799,957 | 1/1989 | Vogel | 75/243 |
| 4,954,170 | 9/1990 | Fey et al. | 75/229 |
| 4,999,336 | 3/1991 | Nadkarni et al. | 505/1 |
| 5,070,591 | 12/1991 | Quick et al. | 29/527.4 |
| 5,422,065 | 6/1995 | Hauner et al. | 420/501 |

*Primary Examiner*—Daniel J. Jenkins
*Attorney, Agent, or Firm*—Larry I. Golden; Kareem M. Irfan

[57] ABSTRACT

An electrical contact for use in an electrical switching device is provided having low contact resistance, high wear resistance and high anti-weld characteristics. The contact includes a material composition of between 0.2 and 8% by weight Gr, between 10 and 90% by weight W and the remaining mixture consisting of Ag. The contact is manufactured using a process which yields a unique microstructure characterized by not having an interconnected Gr network around the Ag thereby providing a strong Ag to Ag bond. This process includes the steps of adding the appropriate amounts of Ag, W and Gr powder material together, blending together under low shear conditions to provide a homogenous powder mixture while prohibiting the Gr from smearing onto the Ag, pressing the material mixture to form a contact, and then sintering and coining the contact.

4 Claims, 1 Drawing Sheet

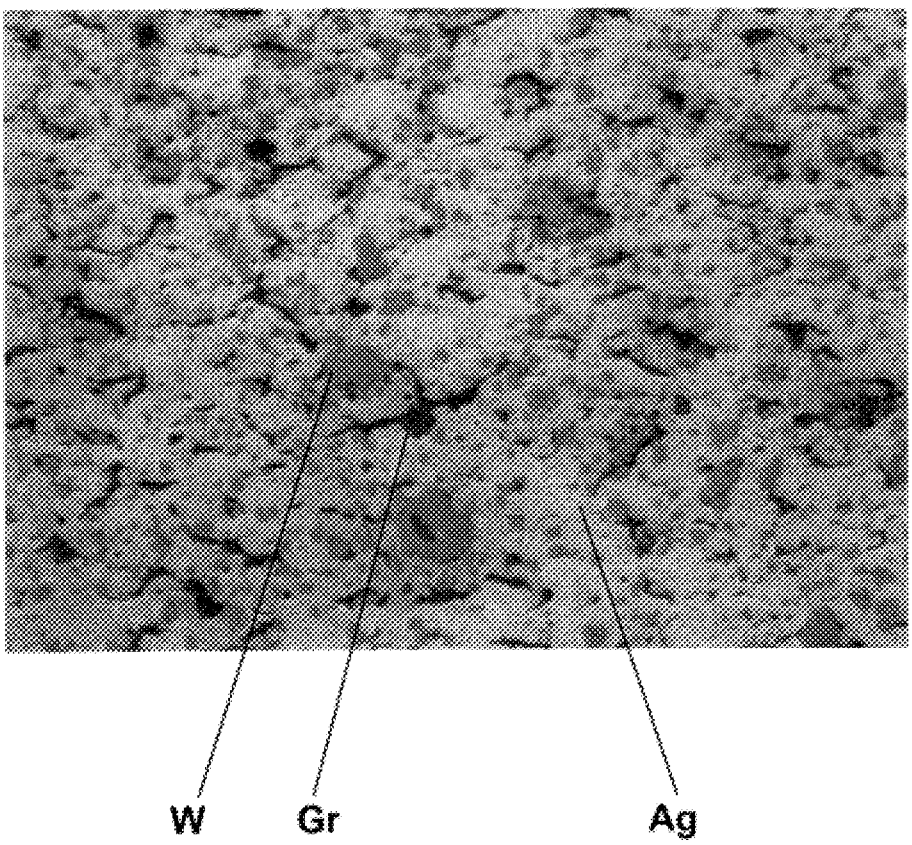
W
Gr
Ag

ELECTRICAL CONTACT FOR USE IN A CIRCUIT BREAKER AND A METHOD OF MANUFACTURING THEREOF

FIELD OF THE INVENTION

This invention relates generally to electrical contacts used in electrical switching devices such as circuit breakers and, more particularly, to an electrical contact composed of materials having properties which provide low contact resistance, high wear resistance and high anti-weld characteristics to the contact. In addition, the invention also relates to a method for the manufacture of such a contact.

BACKGROUND OF THE INVENTION

Some circuit breakers have traditionally used electrical contacts made of silver (Ag) and cadmium oxide. Contacts made from Ag and cadmium oxide provide low contact resistance, high wear resistance and high anti-weld characteristics. However, because of environmental concerns, it is desirable to eliminate cadmium based metals from electrical contacts.

It is known in the art that a contact consisting of Ag and tungsten carbide (WC) provides a contact that has low contact resistance and high wear resistance. It is also known that graphite (Gr) can be added to contact materials as a lubricant to prevent the contacts from welding to one another. However, a drawback is that the wear resistance of the contact is adversely effected by the addition of Gr into the contact material. When the materials are mixed together in powder form, the Gr particles tend to smear onto the Ag thereby allowing the formation of an interconnected Gr to Gr network around the Ag particles when the contact materials are pressed and sintered. This interconnected network of Gr particles causes a weak Ag to Ag sinter bond, which causes the contact to be easily eroded away during an interruption.

Accordingly, there is a distinct need for an improved electrical contact composed of contact materials that provide low contact resistance, high wear resistance and high anti-weld characteristics.

SUMMARY OF THE INVENTION

The present invention provides an electrical contact for use in a circuit breaker which provides low contact resistance, high wear resistance, and high anti-weld characteristics.

In accordance with a preferred embodiment of the present invention an electrical contact for a circuit breaker includes a unique material composition of 0.2–8 weight % Gr, 10–90 weight % W and the remaining mixture consisting of Ag.

Also according to this invention the contact is manufactured using a process which yields a unique microstructure characterized by not having an interconnected Gr network around the Ag and thereby providing a strong Ag to Ag bond. This process includes the steps of adding the appropriate amounts of Ag, W and Gr powder material together, blending together under low shear conditions to provide a homogenous powder mixture while prohibiting the Gr from smearing onto the Ag, pressing the material mixture to form a contact, and then sintering and coining the contact.

BRIEF DESCRIPTION OF THE DRAWING

Other objects and advantages of the invention will be apparent from the following detailed description and the accompanying drawing which is a photomicrograph of an electrical contact according to a preferred embodiment of the present invention.

While the invention is susceptible to various modifications and alternative forms, a specific embodiment thereof has been shown by way of example in the drawing and will be described in detail. It should be understood, however, that it is not intended to limit the invention to the particular form described, but on the contrary, the invention is to cover all modifications, equivalents, and alternatives falling within the spirit and scope of the invention as defined by the appended claims.

DETAILED DESCRIPTION OF THE PREFERRED EMBODIMENTS

For a better understanding of the present invention together with other and further advantages, and capabilities thereof, reference is made to the following disclosure and appended claims in connection with the above-described drawing.

An electrical contact according to the present invention is for use in electrical switching devices that control electrical current, such as switches and circuit breakers. Circuit breakers are commonly used for providing automatic circuit interruption upon detection of undesired overcurrent conditions on the circuit being monitored. These overcurrent conditions include, among others, overload conditions, ground faults and short-circuit conditions.

Circuit breakers typically include an electrical contact on a movable blade which rotates away from a stationary contact in order to interrupt the current path. In response to an overcurrent condition, circuit breakers generally move the blade to break the current path by tripping a spring-biased operating mechanism which forces the blade and its contact away from the fixed contact.

Contacts used in circuit breakers are typically required to have low contact resistance, high wear resistance and high anti-weld characteristics. Because of this requirement, electrical contacts were composed of Ag for its high electrical conductivity properties and cadmium oxide for its resistance to erosion and welding. However, due to concerns of how cadmium effects the environment, it was desirous to eliminate its use in electrical contacts.

The electrical contact according to the present invention will now be described in detail.

At first, a contact consisting of Ag and tungsten (W), mixed in powder form, was investigated to determine if it would satisfactory replace a contact made with Ag and cadmium oxide. Although the Ag—W contact satisfied the low contact resistance and high wear resistance requirements, it was found that it would weld to a mating contact during a circuit interruption. Arcing that occurs during circuit interruptions caused the Ag of both contacts to melt and pool together which would solidify together when it cooled thereby welding the two contacts together.

Next, the inventors fabricated a contact made from Ag and Gr materials. This Ag—Gr contact had high anti-weld characteristics; however, it had low wear resistance.

The inventors then added graphite (Gr) to the Ag—W mixture to act as a lubricant to provide anti-weld properties. The inventors found that the Ag—W—Gr contact fulfilled the required low contact resistance, high wear resistance and high anti-weld requirements. It was determined that the optimum combination of the material mixture is 0.2–8 weight % Gr, 10–90 weight % W and the remaining mixture consisting of Ag. The Ag provides superior electrical properties, the W provides erosion resistant properties while Gr provides anti-weld properties. This novel Ag—W—Gr contact composition provides the advantage of an anti-weld contact which maintains high conductivity and high wear resistance.

The process for manufacturing the contact in accordance with the present invention will now be described. Separate powders of Ag, W and Gr material are weighed and added into a powder mixture. The powder mixture consists of between 0.2 and 8% by weight Gr, between 10 and 90% by weight W and between 2.0 and 89.8% by weight Ag. A homogenous powder mixture is established by blending the powder mixture under low shear or low energy conditions in such a manner that Gr is prevented from smearing onto the Ag. The homogenous powder mixture is then pressed into a required form of the contact. This is followed by sintering the contact at a temperature between 500° C. and the melting point of the Ag. The contact is then coined, or densified, by re-pressing it until most of the air is forced out.

The blending of the material is performed in a 16 qt Liquid-Solids blender which is available as model no. LB 11157, from Patterson Kelly Company, of Fast Stroudsburg, Pa. The blender utilizes a blender bar which has several pins thereon to provide a gentle blending action, which gently mixes the Ag, W and Gr to produce the homogenous powder mixture. This gentle blending action is important to prevent the Gr from smearing onto the Ag particles thereby maintaining the Gr as individual particles and preventing them from being in contact with each other. Because the Gr particles are not in contact with each other, an interconnected Gr network is prevented from forming around the Ag particles during the pressing and sintering steps of the process. The present invention provides an advantage over the prior art in which the contact materials were vigorously blended together, causing the Gr particles to smear onto and around the Ag particles causing the Gr particles to touch each other and inducing an interconnected Gr network to be formed around the Ag particles.

The drawing is a photomicrograph showing the microstructure of the contact according to the present invention. In the photomicrograph, the white portions represent Ag, the black portions represent Gr, and the gray portions represent W. As the photomicrograph shows, the contact according to the invention consists of a microstructure in which the Gr portions are not interconnected around the Ag portions. The aforementioned manufacturing process prohibits the Gr from smearing onto the Ag thereby preventing the Gr portions from bonding to one another and forming an interconnected Gr network around the Ag portions. As can be seen in the photomicrograph, the Ag portions are connected together thereby forming an interconnected Ag network which provides a strong Ag to Ag bond.

From the foregoing detailed description, it can thus be seen that the present invention provides a contact having the characteristics of low contact resistance, high wear resistance and high anti-weld characteristics.

What is claimed is:

1. An electrical contact for use in electrical switching devices, said contact comprising a sintered homogeneous powder mixture having a specified ratio by weight of graphite powder between about 0.2 to about 8 percent, tungsten powder between about 10 to about 90 percent, and silver powder between about 2.0 to about 89.8 percent, the graphite powder maintaining its structural integrity so as to avoid smearing onto the silver powder and bonding between the graphite powder.

2. An electrical contact composed of a specified ratio by weight of graphite, tungsten and silver for use in electrical switching devices, said contact having a microstructure comprising:

tungsten powder which is interconnected;

graphite powder which is not interconnected; and silver powder which is interconnected, the microstructure being formed by low shear blending and then sintering a homogeneous mixture of the powders.

3. An electrical contact, as claimed in claim 2, wherein the specified ratio by weight comprising graphite powder between about 0.2 to about 8 percent, tungsten powder between about 10 to about 90 percent, and silver powder between about 2.0 to about 89.8 percent.

4. An electrical contact for use in electrical switching devices, the contact comprising a specified ratio by weight of graphite powder between about 0.2 to about 8 percent, tungsten powder between about 10 to about 90 percent, and silver powder between about 2.0 to about 89.8 percent, the graphite powder maintaining its structural integrity, the contact being formed by a process involving blending a mixture of the tungsten, graphite and silver powders together under low shear conditions so as to avoid smearing the graphite onto the silver, pressing the powder mixture into a required form of the contact, sintering the contact at a temperature between 500° and the melting point of silver, and densifying the contact to eliminate air therefrom.

* * * * *